United States Patent [19]

Frazita

[11] 4,359,740

[45] Nov. 16, 1982

[54] PHASED ARRAY ANTENNA WITH EXTINGUISHABLE PHASE SHIFTERS

[75] Inventor: Richard F. Frazita, Deer Park, N.Y.

[73] Assignee: Hazeltine Corporation, Greenlawn, N.Y.

[21] Appl. No.: 875,471

[22] Filed: Feb. 6, 1978

[51] Int. Cl.[3] ..... H01Q 3/30

[52] U.S. Cl. ..... 343/703; 343/854

[58] Field of Search ..... 343/754, 777, 778, 854, 343/703, 876

[56] References Cited

U.S. PATENT DOCUMENTS

| | | | |
|---|---|---|---|
| 3,056,961 | 10/1962 | Mitchell | 343/876 |
| 3,378,846 | 4/1968 | Lowenschuss | 343/703 |
| 3,406,399 | 10/1968 | Alsberg | 343/854 |
| 3,699,584 | 10/1972 | Hrivnak et al. | 343/854 |
| 3,803,621 | 4/1974 | Britt | 343/854 |
| 3,953,853 | 4/1976 | Carter et al. | 343/854 |
| 4,044,360 | 8/1977 | Wolfson et al. | 343/778 |

*Primary Examiner*—Eli Lieberman

*Attorney, Agent, or Firm*—E. A. Onders; F. R. Agovino

[57] ABSTRACT

In a phased array antenna wherein signals are supplied to a plurality of antenna elements by a coupling network which includes digital phase shifters for varying the phase of wave energy signals supplied to the elements, there is provided apparatus for discontinuing the supply of wave energy signals to the elements through any malfunctioning phase shifter.

1 Claim, 7 Drawing Figures

PHASED ARRAY ANTENNA WITH EXTINGUISHABLE PHASE SHIFTERS

BACKGROUND OF THE INVENTION

This invention relates to phased array antennas and particularly to apparatus for preventing the degradation of antenna beam pointing accuracy in the event of a phase shifter malfunction.

One of the characteristics of most phased array antenna systems, because of the large number of antenna elements which are usually provided, is the feature that a failure of signals supplied to any particular element does not result in an excessive degradation of antenna performance. The system therefore "fails soft" or slowly degrades as elements fail. In microwave landing systems, however, the antenna beam pointing accuracy is especially critical, so that aircraft angular location can be determined with precision. U.S. Pat. No. 4,041,501 to Frazita, et al. discloses a phased array antenna system which is useful for microwave landing systems, and which contains a reduced number of active phase shifters as compared to prior art phased array antennas. In antenna systems of this type, wherein accurate beam pointing is required, and wherein a single phase shifter provides signals to several antenna elements, a malfunction of one of the phase shifters can produce substantial degradation of antenna performance, particularly with respect to antenna beam pointing accuracy. According to prior art techniques, it is possible to detect the malfunction of a phase shifter by the use of built-in test equipment (BITE) at the phase shifter. BITE enables rapid and automatic detection of a phase shifter malfunction and enables the system operator to arrange for replacement of the failed component. While BITE ensures that a failure will be quickly detected, it is still necessary to discontinue use of the antenna system until the failed component is replaced if accurate system beam pointing is to be maintained. Such unscheduled system shut downs can be costly and hazardous, particularly at busy air terminals.

It is an object of the present invention to provide an apparatus which prevents a phase shifter malfunction from affecting the beam pointing accuracy of a phased array antenna, and therefore enables the antenna system to remain in operation until the malfunctioning phase shifter can be conveniently replaced.

It is a further object of the invention to provide such an apparatus which easily interfaces with existing phase shifter designs, and can be implemented at relatively small incremental cost for the antenna system.

SUMMARY OF THE INVENTION

In accordance with the invention, there is provided apparatus for cutting off the supply of wave energy signals through a malfunctioning phase shifter in a phased array antenna having a plurality of antenna elements and a coupling network including phase shifters for supplying wave energy signals to the elements. The apparatus includes means associated with each of the phase shifters for detecting a malfunction and for generating an output signal representative of a malfunction in the phase shifter. There is also provided a switch associated with each of the phase shifters and responsive to the malfunction representative output signal for preventing passage of wave energy signals to the antenna elements through the malfunctioning phase shifter.

In one embodiment, the switch may be realized by providing a diode connected across a transmission line in the coupling network in series with the phase shifter. In another embodiment, the switch may be implemented using the 180° bit of a diode phase shifter itself. In the latter case, the 180° bit of the diode phase shifter can be used as a switch by reversing the bias signal supplied to one of the diodes in the 180° bit with respect to the bias signal supplied to the other diode. The phase shifter, malfunction detecting apparatus and switch are conveniently arranged in a single package.

For a better understanding of the present invention, together with other and further objects thereof reference is made to the following description, taken in conjunction with the accompanying drawings, and its scope will be pointed out in the appended claims.

FIGS. *3a* and *3b* are detailed schematic diagrams of an embodiment of the present invention wherein the 180° bit of a phase shifter also forms a switch.

Figure 4:
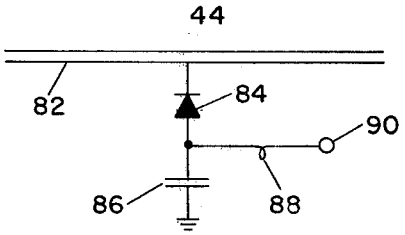

FIG. 4 is a schematic diagram of an RF switch usable in the present invention.

Figure 1:
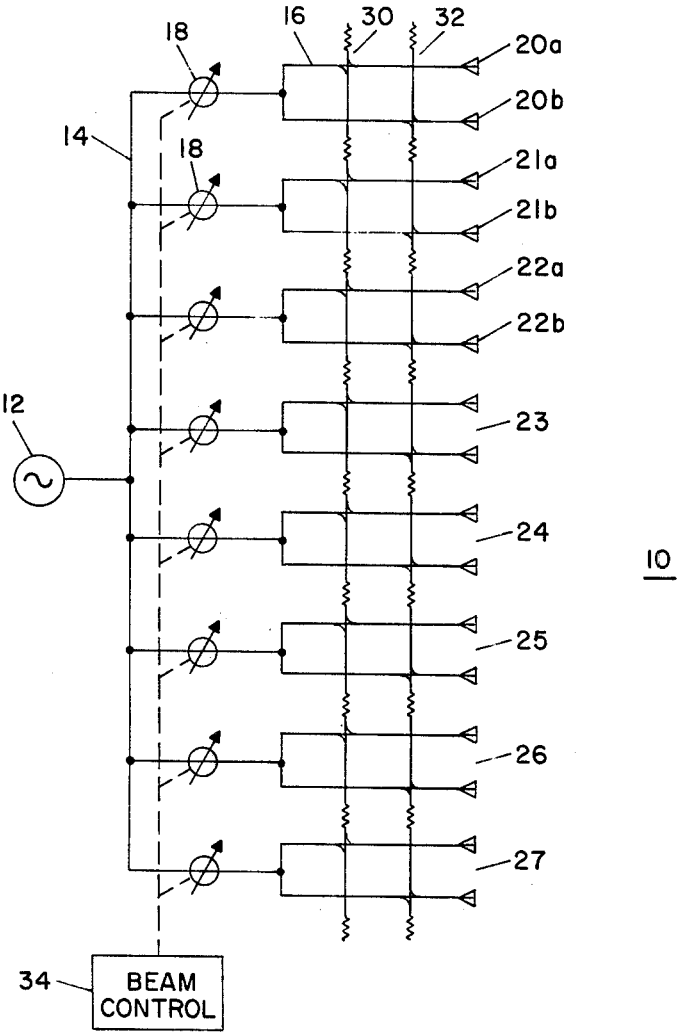
FIG. 1 is a schematic illustration of a phased array antenna system having apparatus in accordance with the present invention.
Figure 5:
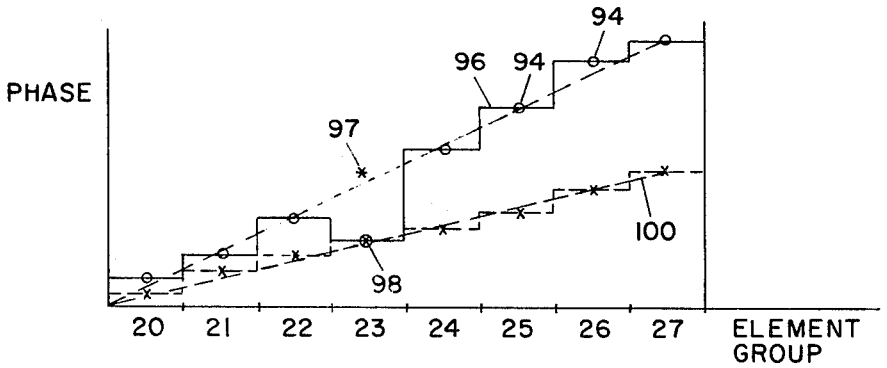

FIG. 5 is a graph illustrating phase with respect to element groups for the array antenna of FIG. 1.

Figure 6:
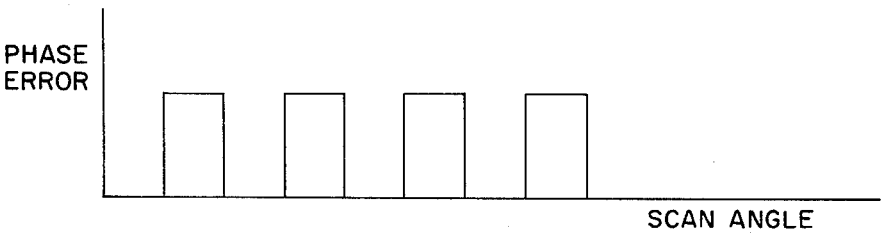

FIG. 6 is a graph illustrating phase error as a function of scan angle, when one of the phase shifters of the FIG. 1 antenna has malfunctioned.

DESCRIPTION OF THE INVENTION

FIG. 1 illustrates a phased array antenna of the type described in prior U.S. Pat. No. 4,041,501 to Frazita et al. The system includes a transmitter 12 which is connected to antenna elements by coupling network 14. Network 14 includes a plurality of digital phase shifters 18. Phase shifter control signals are provided by control unit 34, various designs for which are well known to those skilled in the art. The output of each phase shifter 18 is connected to a corresponding one of the power dividers 16 and signals from each of the phase shifters are supplied to a corresponding one of the element groups 20, 21, 22, etc. The antenna element groups 20, 21, 22 comprise element pairs 20*a*, 20*b*, 21*a*, 21*b*, etc., respectively. Transmission lines 30 and 32 interconnect the element groups and cause signals supplied to the input of any one of power dividers 16 to be distributed to elements in all the element groups of the array.

The antenna coupling network 14 of the type shown in FIG. 1 enables a phased array antenna to radiate signals into a selected region of space and suppress radiation into other regions of space, thereby allowing a large effective element spacing without undesired grating lobes. As a result, the array can have a smaller number of phase shifters than prior art array antennas which perform the same function. The array 10 illustrated in FIG. 1 has eight phase shifters which supply signals to 16 antenna elements.

Because of the reduced number of phase shifters, the array 10 is more susceptible to beam pointing errors which arise on account of failure of a single phase shifter. FIG. 5 illustrates the antenna element phase for two particular beam pointing angles. An ideal phase function 92 for one beam pointing direction is approximated by selected phase values 94 for the signals supplied directly to the element groups. In the event one of the phase shifters of the array, for example the phase shifter associated with element group 23, malfunctions and causes one of the phase shifter bits to be inoperative, the phase of the signals supplied to the elements in group 23 will deviate from the typical step function 96 and instead of having the desired phase value 97 will have a different phase value 98, which differs from the desired phase value according to which of the phase shifter bits has failed.

At another beam pointing direction, for which the antenna has a different ideal phase function 100, the phase of signals supplied to all elements corresponds to the same phase as would be supplied in the event the phase shifter associated with element group 23 had not failed. This results because the failed phase shifter has the same phase value 98 as it would normally have for the beam pointing direction corresponding to curve 100. Thus, for an antenna beam radiated in the direction corresponding to curve 92, there exists a phase error in the signal supplied to element group 23 when the corresponding phase shifter fails, and there exists no phase error when the antenna is directed to radiate in the direction corresponding to phase function 100.

The phase error of signals supplied to element group 23 results in an angular pointing error of the antenna beam. Since the phase error itself is a function of scan angle, as illustrated by the curve of FIG. 6, the antenna beam pointing error is also a function of scan angle. This dependency on antenna pointing angles makes it difficult to detect the error using a monitor in the antenna beam and it is not possible to correct the beam pointing error by adjusting the system by a fixed amount.

The inventor has determined that it is better to discontinue the supply of wave energy signals to the antenna elements through a malfunctioning phase shifter than to continue to supply signals to the elements with an incorrect phase. Supplying the element group with signals having a phase which is incorrect during only certain antenna beam pointing directions can result in a direction variable error which cannot be compensated by usual correction methods, and leads to navigational errors in a microwave landing system, which can be extremely hazardous. The inventor has determined that by discontinuing the supply of signals to the element group associated with a malfunctioning phase shifter, only a very small residual beam pointing error remains and the residual error is a fixed function of radiation angle. In addition, there is an acceptable increase in antenna sidelobe level.

Figure 2:
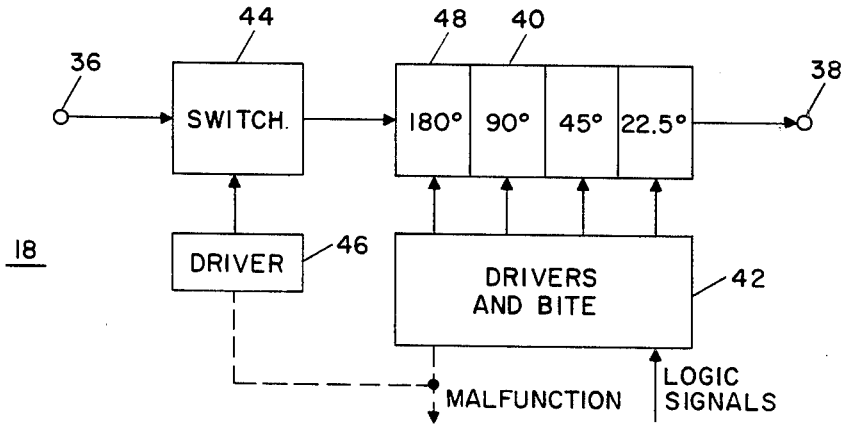
FIG. 2 is a block diagram illustrating the phase shifter and switch of the present invention, used in the antenna system of FIG. 1.

FIG. 2 illustrates a phase shifter and switch combination unit 18, which is usable in the array 10 of FIG. 1. Unit 18 of FIG. 2 includes a four-bit phase shifter 40, which is provided with control signals from a driver and BITE circuit 42. The phase shifter may be of any suitable type. Diode or ferrite digital phase shifters are usually used in connection with phased arrays of the type shown in FIG. 1. Circuit 42 receives from control unit 34 logic signals representative of a desired phase and converts those signals into suitable voltages and currents for controlling the RF portions of the phase shifter. In accordance with design principles known to those skilled in the art, circuit 42 also includes built-in test equipment (BITE), which provides an output signal in the event the phase shifter is not functioning properly. Preferably, the BITE detects failures in the logic and power supply portions of the driver circuit and also detects failures of the driver circuit to properly drive the phase shifter. If the phase shifter is of the ferrite type, wherein a current is driven through a wire and magnetically changes the state of the ferrite material of the phase shifter, the BITE preferably also includes a sensing element responsive to flux changes in the ferrite material to provide an indication of proper functioning of the ferrite portion of the phase shifter. If the phase shifter is of the diode type, the BITE preferably includes circuits for determining whether the proper voltages and currents for biasing the diode elements of the phase shifter are being provided by the driver circuit. These voltages and currents will not have the proper magnitude in the event the diode elements malfunction. The BITE usually functions during time periods when the antenna is not transmitting and tests the response of the phase shifter to simulated phase control signals. The BITE usually provides a single logic output signal which indicates that a malfunction has occurred in the driver circuit or in the components of the phase shifter. This output signal can be supplied to an operator console, there to provide a visual indication of the malfunction. In accordance with the invention, this malfunction indicating signal is also supplied to a driver circuit 46 which operates an RF switch 44. Switch 44, in response to such a signal, opens the input transmission line to phase shifter 40 so that RF signals supplied to input terminal 36 cannot be supplied to output terminal 38.

Those skilled in the art will recognize that switch 44 may be arranged at the output of phase shifter 40. However, in the event the switch is of the type which reflects incoming RF signals, it may be preferable to arrange switch 44 at the input to phase shifter 40, so that standing waves generated by the opened switch do not adversely affect the components of the phase shifter 40.

Figure 3A:
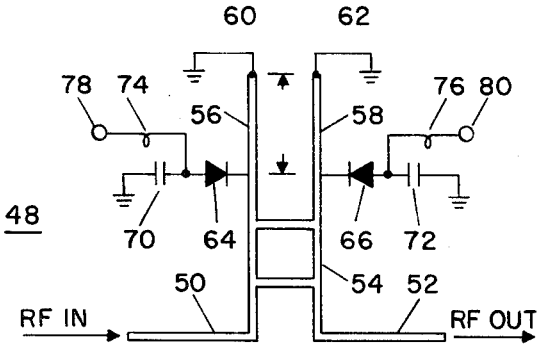

FIG. 3A illustrates one convenient implementation of the invention where the phase shifter is a diode phase shifter which includes a 180° phase shifter bit 48. The circuit of FIG. 3A illustrates an input RF transmission line 50 and an output transmission line 52 which are connected to isolated ports of 3 dB coupler 54. The other ports of coupler 54 are terminated in short circuits 60 and 62. Transmission lines 56 and 58, which are a quarter wavelength, connect short circuits 60 and 62 with diodes 64 and 66. The diodes are arranged between the transmission line and ground in series with capacitors 70 and 72. When diodes 64 and 66 are in a nonconducting state, by reason of a reverse bias being supplied to control terminals 78 and 80, RF signals supplied to the input transmission line 50 are reflected from short circuits 60 and 62 and provided to output transmission line 52. When the bias supply to diodes 64 and 66 is forward biased, these diodes are conducting and serve to short circuit transmission lines 56 and 58 at a point which is a quarter wave closer to coupler 54. Thus, the RF signals traveling between input transmission line 50 and output line 52 travel a distance which is a half wavelength less and thereby undergo a 180° phase shift. Inductors 74 and 76 prevent the coupling of RF signals to control terminals 78 and 80.

Figure 3B:
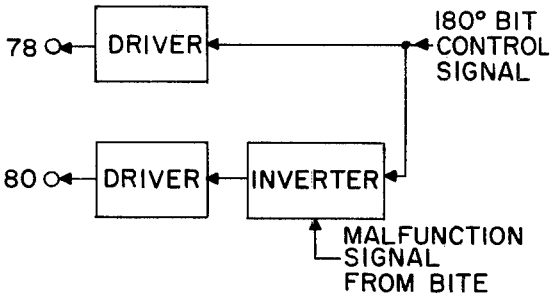

In accordance with one aspect of the present invention, it is possible to use the 180° phase shifter bit 48 of a diode phase shifter, as shown in FIG. 3A, to perform the switching function required in the present invention. This switching function can be achieved by providing opposite biasing to control terminals 78 and 80, so that one diode is in the forward biased condition while the other diode is in the reverse biased condition. This will cause the reflected RF signals to have unequal phase for the proper functioning of phase shifter bit 48, causing the input RF signal on transmission line 50 to be reflected out input line 50. Thus, the 180° phase shifter bit can also be used as a switch. For this operation, it is necessary to provide separate driver circuits for control terminals 78 and 80 as shown in FIG. 3B. One obvious disadvantage of this embodiment is that to detect a malfunction in the 180° phase shifter bit 48 would require more sophisticated circuits and separate BITEs for diodes 64 and 66 and associated drivers to ensure that RF signals through the phase shifter are interrupted if a malfunction occurs.

A preferred form of the switch required by the present invention is illustrated in FIG. 4. Switch 44 is a relatively simple diode type switch wherein diode 84 is connected between transmission line 82 and ground. A forward bias on diode 84 causes the diode to present a short circuit to ground for RF signals on transmission line 82. When diode 84 is reverse biased using terminal 90, the diode presents an open circuit between transmission line 82 and ground and RF signals can pass. Capacitor 86 and inductor 88 prevent interference between the RF and biasing circuits.

Those familiar with the art will recognize that other modifications may be made to the specific components used in the switch and phase shifter combination 18 illustrated in FIG. 2. In certain applications, for example where high transmitter power is involved, it may be necessary or desirable to make use of a ferrite switch, or to use a switch which is connected to a termination so that input signals are not reflected back toward the transmitter.

Those skilled in the art will also recognize that antennas of the type illustrated in FIG. 1 are reciprocal and, provided the proper arrangement of phase shifters is used, may be used to receive signals as well as to transmit. However, certain phase shifter types, such as ferrite phase shifters, are nonreciprocal in nature and require different driving signals for reception than are used for transmission. Nevertheless, the present invention, as it relates to disconnecting a phase shifter circuit from the transmitter or receiver when the phase shifter has malfunctioned, applies equally to receiving and transmitting antenna systems, and it is intended that the claims presented herein be construed to cover apparatus used with either system. The advantages gained by discontinuing the flow of signals through a failed phase shifter, insofar as improved beam direction accuracy, apply equally as well to receiving antennas.

While there have been described what are believed to be the preferred embodiments of the invention, those skilled in the art will recognize that other and further modifications may be made without departing from the spirit of the invention, and it is intended to claim all such embodiments as fall within the true scope of the invention.

I claim:

1. In a phased array antenna having a plurality of antenna elements and a coupling network, including phase shifters, for supplying radio frequency (RF) wave energy signals to said elements, apparatus for cutting off the supply of RF signals to said elements through a malfunctioning phase shifter comprising:

means associated with each of said phase shifters for detecting phase shifter malfunction;

means for generating an output signal representative of said malfunction; and switch means associated with each of said phase shifters and responsive to said output signal for preventing passage of RF signals to said elements through a malfunctioning phase shifter, wherein each of said phase shifters is a diode phase shifter having a 180° phase shifter bit, including first and second reflective diodes, and wherein said switch means comprises the combination of said 180° phase shifter bit and means for driving said first and second reflective diodes to different conductive states.

* * * * *